United States Patent [19]

Tieke et al.

[11] Patent Number: 5,045,436

[45] Date of Patent: Sep. 3, 1991

[54] POLYMER COMPOSITIONS CONTAINING A DISSOLVED DIBENZALACETONE PALLADIUM COMPLEX

[75] Inventors: Bernd Tieke, Giffers; Sheik A. Zahir, Oberwil, both of Switzerland

[73] Assignee: Ciba-Geigy Corporation, Ardsley, N.Y.

[21] Appl. No.: 319,884

[22] Filed: Mar. 3, 1989

Related U.S. Application Data

[63] Continuation of Ser. No. 217,099, Jul. 6, 1988, abandoned, which is a continuation of Ser. No. 5,975, Jan. 21, 1987, abandoned.

[30] Foreign Application Priority Data

Jan. 30, 1986 [CH] Switzerland ..... 348/86

[51] Int. Cl.[5] ..... G03F 7/26; B05D 3/06; B05D 1/18; B05D 3/04

[52] U.S. Cl. ..... 430/315; 430/324; 430/944; 427/53.1; 427/55; 427/443.1; 427/437; 427/438; 427/304; 427/305; 427/306

[58] Field of Search ..... 427/53.1, 55, 443.1, 427/437, 438, 304, 305, 306; 430/944, 315, 324

[56] References Cited

U.S. PATENT DOCUMENTS

| | | | |
|---|---|---|---|
| 3,900,320 | 8/1975 | Rolker et al. | 96/35.1 |
| 3,950,570 | 3/1976 | Kenney | 427/306 X |
| 3,993,807 | 11/1976 | Stabenow et al. | 427/304 X |
| 4,128,672 | 12/1978 | Wunsch et al. | 427/131 |
| 4,347,232 | 8/1982 | Michaelson | 423/584 |
| 4,399,312 | 8/1983 | Russell et al. | 556/7 |
| 4,469,714 | 9/1984 | Wada et al. | 427/54.1 |
| 4,574,095 | 3/1986 | Baum et al. | 427/53.1 |

FOREIGN PATENT DOCUMENTS

| | | | |
|---|---|---|---|
| 0125617 | 11/1984 | European Pat. Off. . | |
| 3139168 | 5/1982 | Fed. Rep. of Germany | 427/53.1 |
| 3148280 | 8/1983 | Fed. Rep. of Germany . | |
| 3326508 | 2/1985 | Fed. Rep. of Germany . | |

OTHER PUBLICATIONS

Chem. Comm., 1970, 1065–6.

Pappas, "UV-Curing Sci. and Techn.", Ch. 9, p. 230 (1978).

J. Electrochem. Sci. Techn. 132, 2081–4 (1985).

*Primary Examiner*—Cynthia Hamilton

*Attorney, Agent, or Firm*—Harry Falber

[57] ABSTRACT

The invention relates to compositions containing a) at least one organic polymer and b) a dibenzalacetone palladium complex of formula I

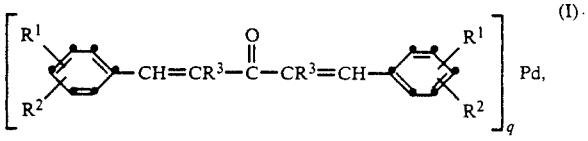

(I)

which is homogeneously dissolved in said polymer but is not copolymerisable therewith, in which formula I $R^1$ is hydrogen, $C_1$-$C_{18}$alkyl, $C_1$-$C_{18}$alkoxy or unsubstituted or substituted phenyl, $R^2$ has one of the meanings of $R^1$ or is also an amino, nitro or cyano group, an $-(O-C_mH_{2m})_n-OR^4$ or $-O-CH_2-CH\cdot OR^4-CH_2\cdot OR^5$ radical or a halogen atom or a glycidyl ether radical, $R^3$ is hydrogen or $C_1$-$C_4$alkyl or the two groups $R^3$ together form a $C_2$-$C_4$polymethylene chain, $R^4$ and $R^5$ have one of the meanings of $R^1$, q is a value from 1 to 3.5, m is a value from 2 to 6 and n is a value from 0 to 20, with the proviso that the composition does not contain a polymer with an olefinic double bond.

Said compositions can be used for metal deposition without current or for producing conductive patterns.

3 Claims, No Drawings

POLYMER COMPOSITIONS CONTAINING A DISSOLVED DIBENZALACETONE PALLADIUM COMPLEX

This application is a continuation of application Ser. No. 217,099, filed July 6, 1988.

The invention relates to polymer compositions containing a dissolved dibenzalacetone palladium complex, to a process for metal deposition without current on substrate surfaces, as well as to the use of said polymer compositions for the preparation of metallised surfaces or of conductive patterns on substrate surfaces.

It is known from U.S. Pat. No. 3 993 807 that solutions of complexes of palladium, triphenyl phosphite and an olefinically or acetylenically unsaturated organic compound containing 3 to 16 carbon atoms or of dibenzalacetone palladium complexes may be employed for metal deposition without current on substrates such as metals, oxidised metals and plastics. The substrates to be coated are immersed one or more times in a solution of the palladium complexes, preferably in benzene or toluene solutions, and heated to 100°-300° C., with palladium being deposited on the substrate surface. The substrates so coated are suitable for metal deposition without current. However, if the substrate to be metallised is pretreated with an activating bath, this may lead to problems (insufficient crosslinking, swelling of the surface).

Mixtures of polymers and organometallic compounds are described in published European patent application 125 617. Mention is made of Pd(II) complexes but not of Pd° complexes, e.g. dibenzalacetone palladium complexes. Pd metal can be deposited from said Pd(II) complexes either by reduction or by heating to relatively high temperatures. According to published European patent application 125 617, the thermally activated polymer surfaces obtained are suitable for metal deposition without current.

The present invention relates to compositions containing a) at least one organic polymer and b) a dibenzalacetone palladium complex of formula I

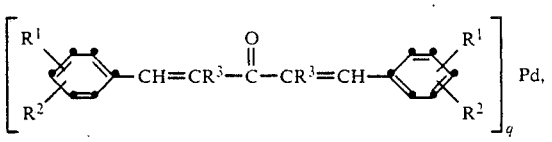

(I)

which is homogeneously dissolved in said polymer but is not copolymerisable therewith, in which formula I $R^1$ is hydrogen, $C_1$-$C_{18}$alkyl, $C_1$-$C_{18}$alkoxy or unsubstituted or substituted phenyl, $R^2$ has one of the meanings of $R^1$ or is also an amino, nitro or cyano group, an $-(-O-C_mH_{2m})_n-OR^4$ or $-O-CH_2-CH.OR^4-CH_2.OR^5$ radical or a halogen atom or a glycidyl ether radical, $R^3$ is hydrogen or $C_1$-$C_4$alkyl or the two groups $R^3$ together form a $C_2$-$C_4$polymethylene chain, $R^4$ and $R^5$ have one of the meanings of $R^1$, q is a value from 1 to 3.5, m is a value from 2 to 6 and n is a value from 0 to 20, with the proviso that the composition does not contain a polymer with an olefinic double bond.

Alkyl and alkoxy groups $R^1$, $R^2$, $R^4$ and $R^5$ may be straight chain or branched, e.g.: methyl, ethyl, n-propyl, isopropyl, n-butyl, sec-butyl, tert-butyl, n-pentyl, n-hexyl, n-heptyl, n-octyl, 2-ethylhexyl, n-decyl, n-dodecyl, n-tetradecyl, n-hexadecyl or n-octadecyl, as well as methoxy, ethoxy, n-propoxy, isopropoxy, n-butoxy, sec-butoxy, tert-butoxy, pentoxy or hexoxy. $R^1$, $R^2$, $R^4$ and $R^5$ as substituted phenyl carry non-polar substituents, e.g. $C_1$-$C_4$alkyl or $C_1$-$C_4$alkoxy radicals, with preferred substituents being methyl, ethyl or methoxy.

Examples of preferred substituted phenyl radicals $R^1$, $R^2$, $R^4$ and $R^5$ are o-, m- or p-tolyl, o-, m- or p-methoxyphenyl or 2,3-, 2,4-, 2,5-, 2,6- or 3,5-dimethylphenyl.

In the $-(-O-C_mH_{2m})_n-OR^4$ group, m is preferably a value from 2 to 4 and n is preferably a value from 0 to 10, most preferably from 0 to 6. The $C_mH_{2m}$ group is preferably ethylene, 1,2- or 1,3-propylene or 1,4-butylene.

$R^2$ as a halogen atom may be fluorine, chlorine, bromine or iodine. Preferred halogen atoms $R^2$ are chlorine and bromine, with chlorine being most preferred.

$R^2$ as a glycidyl ether radical is preferably a group of formula II

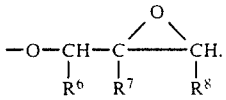

(II)

wherein each of $R^6$ and $R^8$ is a hydrogen atom, in which case $R^7$ is a hydrogen atom or a methyl group, or wherein $R^6$ and $R^8$ together are $-CH_2-CH_2-$, in which case $R^7$ is a hydrogen atom.

$R^2$ as a glycidyl ether radical is most preferably a group of formula III

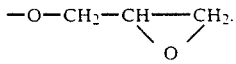

(III)

$R^3$ as $C_1$-$C_4$alkyl is preferably straight chain, e.g. methyl, ethyl, propyl or butyl, with methyl being particularly preferred.

$R^3$ is preferably hydrogen.

If both groups $R^3$ together form a $C_2$-$C_4$polymethylene chain, then said chain is for example ethylene, trimethylene or tetramethylene.

$R^4$ and $R^5$ are preferably hydrogen.

The compounds of formula I may also be present in the form of mixtures, in which case each symbol q may have a different meaning. Preferably, q is a value from 2 to 3.5.

Preferred compositions are those containing compounds of formula I wherein $R^1$ is hydrogen, $R^2$ is $C_1$-$C_{12}$alkyl, $C_1$-$C_4$alkoxy, halogen or a glycidyl ether radical, $R^3$ is hydrogen and q is a value from 2 to 3.5.

Particularly preferred compositions are those containing compounds of formula I wherein $R^1$ is hydrogen, $R^2$ is $C_1$-$C_5$alkyl, preferably isopropyl, $R^3$ is hydrogen and q is a value from 2 to 3.5.

Preferably, each of the groups $R^2$ is in the p-position.

Surprisingly, the palladium complexes of formula I can be dissolved in high concentrations in a large number of commercially available polymers. The polymers may be either soluble or insoluble in organic solvents, i.e. the polymers may be linear or crosslinked. However, the precursors of the crosslinked polymers must be soluble in organic solvents.

Solvents which do not decompose the palladium complex of formula I are employed, with apolar organic solvents being preferred.

Examples of such solvents are aliphatic or aromatic hydrocarbons such as n-hexane, n-heptane, cyclohexane, benzene, toluene or xylene; ethers such as di-n-butyl ether, diethyl ether, diphenyl ether, 1,4-dioxane, anisole, tetrahydrofuran, diethylene glycol diethyl ether, ethylene glycol dimethyl ether or triethylene glycol dimethyl ether; halogenated hydrocarbons such as carbon tetrachloride, chlorobenzene, bromobenzene, chloroform, dichloromethane or 1,2-dichloroethane; ketones such as cyclohexanone, methyl ethyl ketone, acetophenone or acetone; as well as esters such as ethyl acetate. Preferred compositions are those containing as component a) a polymer or polymer mixture which is soluble in organic solvents.

The respective polymers are regarded as soluble if they dissolve in the relevant solvent at room temperature at a concentration of at least 1 mg/l, preferably of at least 10 mg/l.

Compounds of a wide variety of different classes or mixtures of said compounds may be employed as polymer substrates provided they do fall under the definitions given above.

The polymers preferably have a glass transition temperature of more than 90° C.

The polymer components in the mixtures of the invention must be free of olefinic double bonds or conjugated, non-aromatic double bond systems.

If the polymer components contain crosslinkable groups for a crosslinking reaction which is to be carried out after the preparation of the palladium complex-/prepolymer mixture, then a palladium complex which does not become incorporated into the polymer matrix in the subsequent crosslinking step is selected.

Examples of classes of polymers suitable for use are:

1. Polymers of monoolefins and diolefins, for example polyethylene (which may be crosslinked), polypropylene, polyisobutylene, polybutene-1, polymethylpentene-1, as well as polymers of cycloolefins, for instance of cyclopentene or norbornene.

2. Mixtures of the polymers mentioned under 1), for example mixtures of polypropylene with polyisobutylene.

3. Copolymers of monoolefins and diolefins with each other or with other vinyl monomers, e.g. ethylene/propylene, propylene/butene-1, propylene/isobutylene, ethylene/butene-1, ethylene/alkyl acrylate, ethylene-/alkyl methacrylate or ethylene/vinyl acetate copolymers.

4. Polystyrene, poly-(p-methylstyrene).

5. Copolymers of styrene or $\alpha$-methylstyrene with acrylic derivatives, e.g. styrene/acrylonitrile, styrene-/alkyl methacrylate, styrene/maleic anhydride, styrene/acrylonitrile/methyl acrylate; mixtures of high impact strength from styrene copolymers and another polymer, e.g. from a polyacrylate, and block copolymers of styrene, e.g. styrene/ethylene/butylene/styrene or styrene/ethylene/propylene/styrene.

6. Graft copolymers of styrene, e.g. styrene and acrylonitrile on polyalkyl acrylates or polyalkyl methacrylates.

7. Halogen-containing polymers, e.g. polychloroprene, chlorinated or sulfochlorinated polyethylene, epichlorohydrine homo- and copolymers, in particular polymers from halogen-containing vinyl compounds, e.g. polyvinyl chloride, polyvinylidene chloride, polyvinyl fluoride, polyvinylidene fluoride, as well as copolymers thereof, e.g. vinyl chloride/vinylidene chloride, vinyl chloride/vinyl acetate or vinylidene chloride/vinyl acetate copolymers; as well as chlorinated rubbers.

8. Polymers which are derived from derivatives (esters) of $\alpha,\beta$-unsaturated acids, e.g. polyacrylates, polymethacrylates and polyacrylonitriles.

9. Copolymers from the monomers mentioned under 8) with each other or with other unsaturated monomers, e.g. acrylonitrile/alkyl acrylate, acrylonitrile/alkoxyalkyl acrylate or acrylonitrile/vinyl halide copolymers.

10. Homopolymers and copolymers of cyclic ethers, e.g. polyalkylene glycols, polyethylene oxide, polypropylene oxide or copolymers thereof with bisglycidyl ethers.

11. Polyphenylene oxides and sulfides, and mixtures thereof with polystyrene.

12. Polyimides, polyether imides, polyester imides and polybenzimidazoles.

13. Polyesters which are derived from dicarboxylic acids and diols and/or from hydroxycarboxylic acids or the corresponding lactones, e.g. polyethylene terephthalate, polybutylene terephthalate, poly-1,4-dimethylolcyclohexane terephthalate, polyhydroxybenzoates as well as block-polyether-esters derived from polyethers having hydroxyl end groups.

14. Polycarbonates.

15. Polysulfones, polyethersulfones and polyetherketones.

16. Crosslinked or crosslinkable polymers which are derived from aldehydes on the one hand and phenols, on the other hand, e.g. phenol/formaldehyde resins.

17. Non-drying alkyd resins.

18. Crosslinkable acrylic resins derived from substituted acrylic esters, e.g. from polyacrylates containing epoxy groups.

19. Alkyd resins, polyester resins or acrylate resins in admixture with epoxy resins as crosslinking agents.

20. Crosslinked or crosslinkable epoxy resins which are derivid from polyepoxides, e.g. from bisglycidyl ethers or from cycloaliphatic diepoxides, as well as linear epoxy resins, e.g. those based on bisphenol A.

21. Derivatives of natural polymers, which derivatives are chemically modified in a polymer-homologous manner, e.g. cellulose acetates, cellulose propionates and cellulose butyrates, or the cellulose ethers, e.g. methylcellulose.

22. Mixtures (polyblends) of polymers as mentioned above, e.g. PVC/EVA.

Preferred compositions are those which in which component a) is a polymer or polymer mixture which is soluble in organic solvents.

Particularly preferred compositions are those in which the polymer is selected from the group consisting of polystyrene, polyvinyl chloride, polycarbonate, polyarylate and polyimide which is soluble in organic solvents.

The compositions of the invention may equally as well contain as component a) a crosslinked or crosslinkable polymer, for example an epoxy resin. In such as case, a palladium complex which does not become incorporated into the polymer backbone but merely remains dissolved therein should be selected.

Accordingly, the invention preferably relates to compositions as defined above in which component a) is an epoxy resin.

Examples of epoxy resins which are suitable for the formation of crosslinked substrates and examples of hardeners for such resins can be found in *Ullmanns Enzyklopadie der technischen Chemie* (Ullmann's Enyclopaedia of Industrial Chemistry), Vol. 10, pp. 536–580 (4th edition, Verlag Chemie, Weinheim/Bergstrasse; 1975).

As a rule, the proportion of dibenzalacetone palladium complex of formula I in the compositions of the invention is 0.1 to 25% by weight, preferably 0.5 to 10% by weight, based on the entire mixture.

The compositions of the invention may also contain further additives customarily employed in the art of epoxy resins. Examples of such additives are pigments, dyes, reinforcing agents such as glass fibres, flame retardants, antistatic agents, flow control agents, mould release agents, adhesion promoters, antioxidants and light stabilisers.

In addition to further customary additives, the mixtures of the invention may also contain electrically conductive fillers c), conveniently in amounts of 1 to 90% by weight, preferably 40 to 80% by weight, based on the total weight of the mixture, with the sum of components a) to c) being 100% by weight. Suitable electrically conductive fillers are those of organic or inorganic nature such as carbon black and graphite or metals of Periodic Groups Vb, VIb, VIII and Ib, alloys and salts thereof such as halides, oxides and sulfides.

Examples of suitable metals and metal compounds are: vanadium, niobium, tantalum, molybdenum, tungsten, copper, noble metals such as Pt, Pd, Ag and Au, AgPd alloys, silver oxide, silver iodide, copper(II) sulfide, copper(I) iodide, copper(II) oxide, gold(III) bromide, gold(III) iodide and gold(III) oxide, molybdenum(IV) sulfide, niobium(IV) chloride and niobium(IV) oxide, palladium iodide, palladium oxide, platinum(VI) bromide and platinum(VI) chloride, vanadium(III) chloride, vanadium(IV) oxide, tungsten(VI) chloride and tungsten(VI) oxide. Preferred metals are silver, copper, silver/palladium alloys, palladium, platinum, gold, tungsten and molybdenum. Particularly preferred metals are Au, Pt, AgPd, with Ag and Cu powder being most preferred.

The compositions of the invention can be prepared in simple manner by conjointly dissolving the polymer, or a crosslinkable precursor thereof in combination with a suitable crosslinking agent, and the complex and subsequently processing the resultant solution to films in a manner known per se or applying said solution to a suitable substrate and, if desired, then effecting curing.

Suitable substrates are customary moulding materials which are preferably non-conductive. Examples of such materials are paper, wood, glass, ceramics, semiconductors such as silicon, germanium or gallium arsenide and, in particular, plastics, preferably cured epoxy resins.

Metallic substrates, e.g. aluminium or copper, may of course also be coated with the mixtures.

The substrate is coated by customary methods, for example by dipping, coating or spraying methods or by centrifugal, cascade or curtain coating.

However, a sheet may be cast from the mixture of the invention and then subsequently cemented onto a suitable substrate.

The polymer, or a crosslinkable precursor thereof, and the complex of formula I may be dissolved conjointly in a solvent. It is also possible to employ mixtures of different solvents or separate solutions of the polymer, or of a crosslinkable precursor thereof, and the complex in different solvents.

The choice of solvent mixture depends on the respective polymers and complexes employed and can be determined on the basis of routine tests by the person skilled in the art.

In order to improve the adhesion of coatings, an adhesion promoter may be added to the solution. A linear, soluble polyepoxide may for example be employed as adhesion promoter.

The choice of polymers or polymer mixtures and of palladium complexes of formula I depends on the solubility of the components in one another and can likewise be determined on the basis of routine tests by the person skilled in the art.

The compounds of formula I can be prepared by methods which are known per se (q.v. e.g. J. Chem. Soc. D 1970, 1065 and U.S. Pat. No. 4 347 232) by reacting q moles of a compound of formula IV

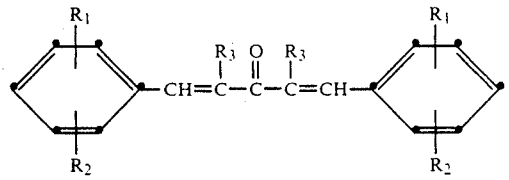

(IV)

with a soluble palladium salt, in the presence of a base and, optionally, of a hydrogen donor. $R_1$, $R_2$, $R_3$ and q are as defined for formula I.

Examples of suitable bases are the alkali metal salts of aliphatic monocarboxylic acids, in particular potassium acetate and sodium acetate. Examples of suitable palladium salts are $PdBr_2$, $PdCl_2$ and $Na_2PdCl_4$, with $Na_2PdCl_4$ being particularly preferred and $PdCl_2$ being most preferred. The reaction is conveniently carried out in an organic solvent which simultaneously acts as hydrogen donor. Examples of suitable solvents are alkanols containing up to 6 carbon atoms, with ethanol being preferred and methanol being most preferred.

The compounds of formula IV can be prepared in a manner known per se, e.g. by a method analogous to that described in U.S. Pat. No. 3 295 974.

The compositions of the invention can be employed for the metallisation without current of plastics or for the preparation of structured metal surfaces on plastics.

It is to be regarded as particularly advantageous that no pretreatment of the surface to be metallized (activating bath, reduction bath) is necessary, that the metal deposition can be carried out on coated surfaces, that the complex of formula I contains no aggressive components which may attack the polymer and that even relatively small amounts of the complex of formula I are sufficient for the metallisation without current of the plastics surface.

Activation of the composition for metal deposition without current is carried out by heating to temperatures above 100° C., preferably to temperatures in the range from 100° to 250° C., in particular from 150° to 200° C. Heating may be effected for example by tempering the sample or by irradiating it with IR sources, e.g. IR lasers, or with the IR proportion of sources of actinic radiation (e.g. xenon lamps, argon lamps, tungsten lamps, carbon arcs, metal halide lamps and metal arc lamps such as mercury lamps).

The temperature treatment causes finely dispersed, catalytically active palladium to be liberated.

Irradiation with IR sources may be effected imagewise, e.g. by a laser beam which is guided over the surface.

Depending on the temperature, the tempering process may last from 1 to 60 minutes; surprisingly, the tempering times are very short. In the tempering process, the palladium complex of formula I is decomposed in accordance with the following scheme (DBA=dibenzalacetone derivative):

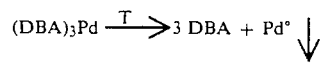

$$(DBA)_3Pd \xrightarrow{T} 3\ DBA + Pd^{\circ} \downarrow$$

Accordingly, the invention also relates to a process for activating polymer surfaces for the purpose of metallisation without current, in which process i) a solution of the complex of formula I in a polymer, as defined above, is applied to a substrate or an unsupported film is prepared from said solution and ii) the arrangement is heated to a temperature above 100° C., whereupon the complex of formula I decomposes, thereby liberating finely dispersed, catalytically active Pd°.

The Pd° clusters thus formed are catalytically active and catalyse the metallisation without current (e.g. nickel or copper plating) of the polymer surface, for example in accordance with the following scheme:

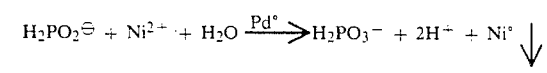

$$H_2PO_2^{\ominus} + Ni^{2+} + H_2O \xrightarrow{Pd^{\circ}} H_2PO_3^{-} + 2H^{+} + Ni^{\circ} \downarrow$$

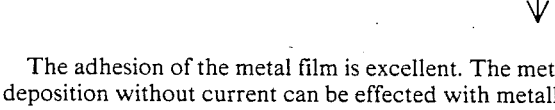

$$CH_2O + 3OH^{-} + Cu^{2+} \xrightarrow{Pd^{\circ}} HCO_2^{\ominus} + 2H_2O + Cu^{\circ} \downarrow$$

The adhesion of the metal film is excellent. The metal deposition without current can be effected with metallisation baths known per se and by customary methods. Examples of suitable metals are copper, nickel, cobalt, silver, gold and tin or cobalt/phosphorus and cobalt-/nickel alloys.

The invention therefore also relates to a process for metal deposition without current on polymer surfaces, in which process the polymer surface is activated as defined above (steps (i) and (ii)) and subsequently iii) the activated polymer surface is metallised without current in a manner known per se.

If a metal pattern is to be prepared on a substrate surface, then it is convenient to apply the composition of the invention in structured form to the substrate, for example by screen printing or by selectively controlled ink transfer printing. Suitable printing processes are described e.g. in German Offenlegungsschrift 3 326 508.

Accordingly, the invention also relates to a process for the preparation of metallic patterns on substrate surfaces, in which process i) a solution of a complex in a polymer, as defined above, is applied in structured form to a substrate, ii) the arrangement is heated to a temperature above 100° C., whereupon the complex of formula I decomposes, thereby liberating finely dispersed, catalytically active Pd°, and iii) the activated polymer surface is metallised without current in a manner known per se.

Structurisation may be effected with a photoresist. To this end a substrate is coated in known manner with a photoresist. The palladium complex of formula I may be dissolved either in the photoresist or in a polymer substrate situated beneath it, preferably in a polymer layer. After irradiating the arrangement with actinic light and subsequently developing the photoresist (positive or negative), the sample is tempered and immersed in a metallisation bath. Metal deposition is then effected either on the structured photoresist or on the polymer substrate which has been structured by the photoresist.

The invention therefore also relates to a process for producing metallic patterns on polymer surfaces, in which process i) a solution of the complex of formula I in a polymer, as defined above, is applied to a substrate or an unsupported film is prepared from said solution, ii) the polymer surface is coated with a positive or negative photoresist, iii) the arrangement is exposed to actinic radiation in a predetermined pattern, iv) the photoresist is developed in a manner known per se, v) the arrangement is heated to a temperature above 100° C., whereupon the complex of formula I decomposes, thereby liberating finely dispersed, catalytically active Pd°, and vi) the activated part of the polymer surface is metallised without current in known manner, which activated part is no longer covered by the photoresist.

A tempering step may of course also be carried out between steps (iii) and (iv) in order to precure the exposed photoresist. Suitable photoresists are those materials customarily employed in the art. The term "photoresist" also comprises olefinically unsaturated compounds. A survey of processes for the production of images with such photoresists and of selected classes of compounds is provided by P.S. Pappas in "UV Curing: Science and Technology", Chapter 9, pp. 230–253 (1973).

Naturally, the photoresist must be selected such that a structure produced by the irradiation and development steps will undergo the tempering step without becoming greatly distorted. Such systems are known to the skilled person or can be selected by routine tests.

If the variant is chosen in which a complex of formula I is disolved in a photoresist, then a radiation-sensitive polymer system containing a polymer with no olefinic double bonds is selected as photoresist. In this process variant, good results can be obtained even with relatively small amounts of the Pd compound. In this case, as a rule less than 10% by weight of the complex of formula I, based on the polymer solution, are sufficient to obtain a catalytically active surface after exposure and tempering. In this variant, it is preferred to employ 1 to 5% by weight of the complex of formula I, based on the polymer solution.

Examples of radiation-sensitive polymer systems containing polymers with no olefinic double bonds are combinations of epoxy resins with photoinitiators of cationic polymerisation.

Preferred combinations of this type are described in published European patent application 153 904; these combinations also constitute an object of the present description. It is particularly preferred to employ combinations of epoxy resins based on bisphenol A or based on phenol novolaks or cresol novolaks with iron-arene photoinitiators. Such mixtures are likewise described in published European patent application 153 904.

Furthermore, the invention also relates to a process for producing metallic patterns on polymer surfaces, in which process i) a composition containing a) a positive or negative photoresist and b) a dibenzalacetone complex of formula I which is homogeneously dissolved in said photoresist but is not copolymerisable therewith, as defined above, is applied to a substrate surface, with the proviso that the photoresist does not contain a polymer with an olefinic double bond, ii) the arrangement is exposed to actinic radiation in a predetermined pattern, iii) the photoresist is developed in a manner known per se, iv) the arrangement is heated to a temperature above 100° C., whereupon the complex of formula I decomposes, thereby liberating finely dispersed, catalytically active Pd°, and v) the parts of the arrangement which are covered by the photoresist are metallised without current in a manner known per se.

In this embodiment it is also preferable to carry out a tempering step between steps (ii) and (iii) in order to precure the exposed photoresist.

The term "exposure to actinic radiation in a predetermined pattern" means both exposure through a photomask containing a predetermined pattern, for example a photographic transparency, as well as exposure to a laser beam which is moved by logic control over the surface of the coated substrate to produce an image.

When producing an image using a photoresist, it is preferred to employ actinic radiation in a wavelength of 200 to 600 nm. Suitable sources of actinic radiation are carbon arcs, mercury vapour lamps, fluorescent lamps containing phosphorus compounds which emit UV light, argon glow lamps, xenon glow lamps, tungsten lamps and photographic flood lamps. X-Rays, electron beams and high-energy radiation may also be employed.

Depending on the nature of the photoresist chosen, a suitable developer may be selected from a wide variety of materials. Development may be effected for example with water, with aqueous or aqueous-organic solutions of a base or acid, or with organic solvents or solvent mixtures.

The invention further relates to the use of the mixtures of the invention for metal deposition without current, in particular for the production of electrically conductive patterns on plastics surfaces. Patterns of high resolution can be obtained by the process of this invention. Such products can for example be employed as printed circuits.

The invention is illustrated in more detail by the following Examples.

PREPARATORY EXAMPLES

Example 1: Tris(dibenzalacetone p,p'-diglycidyl ether) palladium

With vigorous stirring, 15 g of $PdCl_2$ are boiled in a solution of 10.7 g of NaCl in 65 ml of water until the palladium chloride is completely dissolved. The water is then distilled off. The residue is taken up in 200 ml of methanol and the solution is heated to 60° C. 105.9 g of dibenzalacetone bis-p,p'-diglycidyl ether and 42.8 g of sodium acetate.$3H_2O$ are added, followed by the addition of another 175 ml of methanol. After a further 15 minutes at 60° C., the mixture is cooled. A precipitate forms which is isolated by filtration under argon and washed with one 100 ml portion of methanol, with three 100 ml portions of water and then with two more 100 ml portions of methanol. The product is subsequently dried in vacuo at 50° C. For the complete removal of the residual dibenzalacetone bis-p,p'-diglycidyl ether, the crystals are suspended in 700 ml of methanol and then isolated by filtration under argon. Subsequent drying in vacuo affords 100.7 g of violet crystals (97% of theory).

Decomposition range: 120°–160° C. Analysis shows a value of 3.2 for q.

Example 2: Tris(p,p'-diisopropyldibenzalacetone) palladium

This compound is prepared in accordance with U.S. Pat. No. 4 347 232.

Example 3: Bis(dibenzalacetone) palladium

This compound is prepared in accordance with J. Chem. Soc. D 1970, 1065.

APPLICATION EXAMPLES

Example A 20 g of PVC are dissolved in 80 g of tetrahydrofuran, and a solution of 0.6 g of the complex of Example 2 in 30 g of tetrahydrofuran is added. The resultant solution is processed to a film of 200 μm thickness. After the solvent has evaporated off, the film is tempered for 15 minutes at 170° C. and subsequently coated with nickel in a commercially available nickel-plating bath (SHIPLEY Niposit® 468 or PM 980). A nickel coating which adheres well is obtained. A further film is kept in a commercially available copper-plating bath (SHIPLEY Cuposit® CP 78 or 328). A copper coating which adheres well is obtained.

Similar results are obtained with the following metallisation baths:

a) Copper-plating bath. Bath composition according to "Printed Circuit Handbook", 2nd edition, C. F. Coombs, jr. et al., McGraw Hill Book Co., New York, 1979, pp. 5–7: 25 g/l of $CuSO_4.5H_2O$ 60 g/l of sodium gluconate 20 g/l of NaOH 25 g/l of 37% aqueous formaldehyde solution, under a flow of oxygen. Operating temperature: 20° C.

b) Nickel-plating bath. Bath composition according to J. Appl. Electrochem., 1 (1971) 167: 30 g/l of $NiCl_2.6H_2O$ 10 g/l of $NaH_2PO_2.H_2O$ 50 g/l of $NH_4Cl$ 82.4 g/l of sodium citrate.$2H_2O$

Examples B to E

The procedure described in Example A is followed. The operating conditions of experiments A to E are described in the table below. In each case, nickel or copper coatings which adhere well are obtained.

| Ex. | Polymer | Molecular weight ($M_n$ ~) | Tg (°C.) | Solvent | Polymer conc. [% by weight] | Complex of Ex. | Complex conc. [% by weight of polymer] | Tempering stage T[°C.] | Tempering stage t(min) | Coating with Ni | Coating with Cu |
|---|---|---|---|---|---|---|---|---|---|---|---|
| A | PVC | $1.43 \cdot 10^5$ | 90 | THF | 15.4 | 2 | 3 | 170 | 15 | + | + |
| B | polystyrene | $3.8 \cdot 10^5$ | 110 | toluene | 20.0 | 2 | 3 | 170 | 15 | + | + |

-continued

| Ex. | Polymer | Molecular weight ($M_n$) | Tg (°C.) | Solvent | Polymer conc. [% by weight] | Complex of Ex. | Complex conc. [% by weight of polymer] | Tempering stage T[°C.] | Tempering stage t(min) | Coating with Ni | Coating with Cu |
|---|---|---|---|---|---|---|---|---|---|---|---|
| C | Makrolon[1] | $6.4 \cdot 10^4$ | 153 | 1,2-di-chlorethane | 15.4 | 2 | 3 | 170 | 15 | + | + |
| D | polyarylate[2] | $6.9 \cdot 10^4$ | 200 | 1,2-di-chlorethane | 9.5 | 2 | 3 | 170 | 60 | + | —[3] |
| E | Makrolon[1] | $6.4 \cdot 10^4$ | 153 | 1,2-di-chlorethane | 15.4 | 1 | 3 | 170 | 10 | + | + |

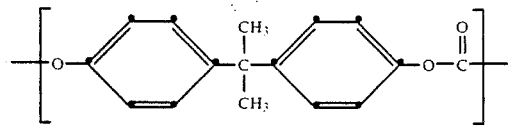

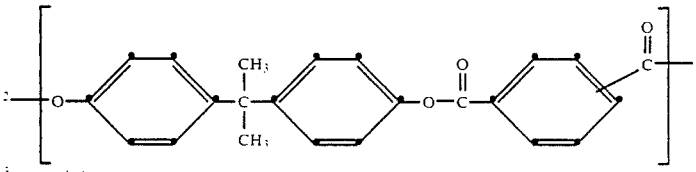

[3]not carried out

Example F

An epoxy resin sheet (60×40×2 mm) is coated with a 50 μm thick polymer film prepared from the composition according to Example C. After the solvent has evaporated off, the sheet is heated for 6 minutes at 170° C. and subsequently immersed in one of the nickel-plating baths described in Example A. A nickel film which adheres well forms on the coated resin surface.

Example G

The procedure described in Example F is repeated. The substrate is a glass sheet.

Example H

The procedure described in Example F is repeated. The substrate is an aluminium sheet.

Example I 0.25 g of the complex of Example 1 are dissolved in a solution of 5 g of a linear polyepoxide*) in 20 g of 1,2-dichloroethane. An epoxy resin sheet (60×40×2 mm) is coated with a 50 μm thick polymer film prepared from the resultant solution. After the solvent has evaporated off, the coated epoxy resin sheet is heated for 6 minutes at 170° C. and then immersed in one of the nickel deposition baths described in Example A. A nickel film which adheres well is obtained on the coated resin surface.

*) The polyepoxide is a linear addition copolymer consisting of a diglycidyl ether based on bisphenol A (epoxide value: 5.3 val/kg) and benzylamine in the molar ratio 1:1. Said polyepoxide is prepared by the method described in J. Polym. Sci. Polym. Chem. Ed., 22, 249 (1984).

Example J 0.5 g of the complex of Example 1, 0.5 g of the linear polyepoxide of Example I and 10.0 g of Makrolon ® (q.v. Example C) are dissolved in 70 g of 1,2-dichloroethane. An epoxy resin sheet is treated with the resultant solution as described in Example I. A nickel film which adheres well is obtained on the coated resin surface.

Example K 11.2 g (56.0% by weight) of a diglycidyl ether based on bisphenol A (epoxide value: 5.25–5.4 val/kg), 7.8 g (39.0% by weight) of hexahydrophthalic anhydride and 1.0 g (5.0% by weight) of the complex of Example 2 are mixed at 90° C. for 15 minutes. Then 0.06 g of benzyldimethylamine is added as accelerator. After a further 5 minutes at 90° C., the mixture is poured into a mould which has been preheated to 100° C. The mixture is then cured for 4 hours at 100° C. and for a further 4 hours at 120° C. After the mould has been removed, the moulded article is tempered for 2 hours at 240° C. and subsequently coated with nickel in a commercially available nickel-plating bath (Shipley Niposit ® 468 or Niposit ® PM 980). A nickel coating which adheres well is obtained.

Nickel-plating can also be carried out using the nickel-plating bath described in Example A. Comparable results are obtained.

Example L 22.4 g (50.8% by weight) of a diglycidyl ether based on bisphenol A (epoxide value: 5.25–5.4 val/kg), 15.4 g (34.9% by weight) of hexahydrophthalic anhydride and 6.3 g (14.3% by weight) of the complex of Example 3 are mixed at 90° C. for 15 minutes. Then 0.1 g of benzyldimethylamine is added as accelerator. After a further 5 minutes at 90° C., the mixture is poured into a mould which has been preheated to 100° C. The mixture is then cured for 4 hours at 100° C. and for a further 4 hours at 120° C. After the mould has been removed, the moulded article is tempered for 1 hour at 240° C. and subsequently coated with nickel in a commercially available nickel-plating bath (Shipley Niposit ® 468 or Niposit ® PM 980). A nickel coating which adheres well is obtained.

Nickel-plating can also be carried out with comparably good results using the nickel-plating bath described in Example A.

Example M 0.25 g of tris(p,p'-diisopropyldibenzalacetone) palladium and 0.2 g of polystyrene are dissolved in 20 ml of toluene. This solution is used as printing ink in a Hewlett-Packard "Thinkjet" printer with modified printing head*). Using this printer a text is written on a transparent sheet for normal copiers (Folex ® X-100). The sheet is then tempered for 15 minutes at 170° C. Subsequently, the sheet is immersed in one of the nickel deposition baths described in Example A (duration 15 minutes). A nickel coating which adheres well to the sheet is obtained on the printed areas.

*) The ink storage vessel is made of aluminium in order to increase resistance to organic solvents. Moreover, all bonds have been prepared using Araldite®, which is also solvent-resistant.

Example N

A solution of 0.5 g of the complex of Example 2 in 15 ml of dichloroethane is added to 20 g of a photoresist comprising 120 parts by weight of a technical epoxy cresol novolak (epoxide content 4.5 equivalents/kg), 50 parts by weight of a technical bisphenol A epoxy resin (epoxide content 0.5 equivalent/kg), 20 parts by weight of talcum, 1 part by weight of Irgalith Green, 2 parts by weight of ($\eta^6$-stilbene)($\eta^5$-cyclopentadienyl)iron(II) hexafluorophosphate and 200 parts by weight of cyclohexanone, and the batch is thoroughly stirred. The resultant mixture is coated on a glass plate (200×100×4 mm) with a 70 μm doctor knife. The photoresist thus applied is dried for 1 hour at 80° C. For structurisation, the photoresist is exposed through a mask (5000 W Hg high pressure lamp Berner M 061), cured for 20 minutes at 135° C., and subsequently developed by being immersed for 1 ½ minutes in cyclohexanone. For Pd° deposition, the coated glass sheet is tempered for 1 hour at 230° C. in a circulating air oven. The sheet is then nickel-plated in one of the nickel-plating baths described under Example A. A nickel coating which adheres well is obtained on the structured surface of the photoresist.

Example O

The procedure of Example N is followed using an epoxy carbon fibre laminate as substrate instead of a glass sheet. After irradiation, curing is effected for 10 minutes at 135° C. After development and metallisation, a nickel coating which adheres well obtained on the structured surface of the photoresist.

What is claimed is:

1. A process for activating a polymer surface for the purpose of making it receptive to subsequent metallization without current, which comprises (a) dissolving a dibenzalacetone palladium complex of formula I in a polymer which contains no olefinic double bond,

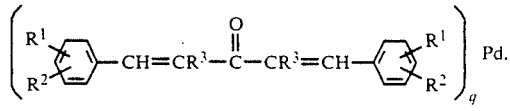

(I)

$R^1$ is hydrogen, $C_1$-$C^{18}$alkyl, $C_1$-$C_{18}$alkoxy or unsubstituted or substituted phenyl, $R^2$ has one of the meanings of $R^1$ or is also an amino, nitro or cyano group, an —(O—$C_mH_{2m}$)—$OR^4$, or —O—$CH_2$—$CHOR^4$—$CH_2$—$OR^5$ radical or a halogen atom or a glycidyl ether radical, $R^3$ is hydrogen or $C_1$-$C_4$alkyl or the two groups $R^3$ together form a $C_2$-$C_4$polymethylene chain, $R^4$ and $R^5$ have one of the meanings of $R^1$, q is a value from 1 to 3.5, m is a value from 2 to 6 and n is a value from 0 to 20, wherein the complex of formula I is not copolymerizable with the polymer, (b) applying a coating of said solution of step (a) to a substrate or preparing an unsupported film from said solution of step (a), and (c) heating said coated substrate of step (b) or unsupported film of step (b) to a temperature over 100° C. to decompose the complex of formula I and concomitantly to liberate finely dispersed, catalytically active $Pd^0$ in the coating or the unsupported film;

(d) metallizing the activated polymer surface by exposing the activated polymer surface to a metallization bath effecting current free metallization of the activated polymer surface.

2. A process according to claim 1, wherein the heating to a temperature above 100° C. is effected by imagewise exposure to IR radiation.

3. A process according to claim 1, wherein the composition is applied in structured form to a substrate.

* * * * *